US009803854B2

(12) United States Patent
Ramotowski et al.

(10) Patent No.: US 9,803,854 B2
(45) **Date of Patent: *Oct. 31, 2017**

(54) METHOD AND APPARATUS FOR CONDITIONING LIQUID HYDROCARBON FUELS

(71) Applicant: LPP COMBUSTION, LLC, Annapolis, MD (US)

(72) Inventors: Michael J. Ramotowski, Columbia, MD (US); Richard Joklik, Annapolis, MD (US); Casey Fuller, Columbia, MD (US); Ponnuthurai Gokulakrishnan, Columbia, MD (US); Leo Eskin, Darnestown, MD (US); Glenn Gaines, Fallston, MD (US); Richard J. Roby, Columbia, MD (US); Michael S. Klassen, Columbia, MD (US)

(73) Assignee: LPP COMBUSTION, LLC., Columbia, MD (US)

( * ) Notice: Subject to any disclaimer, the term of this patent is extended or adjusted under 35 U.S.C. 154(b) by 894 days.

This patent is subject to a terminal disclaimer.

(21) Appl. No.: 14/213,356

(22) Filed: Mar. 14, 2014

(65) Prior Publication Data

US 2014/0199642 A1 Jul. 17, 2014

Related U.S. Application Data

(63) Continuation of application No. 11/296,426, filed on Dec. 8, 2005, now Pat. No. 8,702,420.
(Continued)

(51) Int. Cl.
*F23D 11/44* (2006.01)
*F23K 5/22* (2006.01)

(52) U.S. Cl.
CPC ..... *F23D 11/441* (2013.01); *F23K 5/22* (2013.01); *F23K 2301/205* (2013.01)

(58) Field of Classification Search
CPC ..... F23D 11/441
(Continued)

(56) References Cited

U.S. PATENT DOCUMENTS 696,909 A 4/1902 McCormick et al.
964,031 A 7/1910 Leahy
(Continued)

FOREIGN PATENT DOCUMENTS

CN 1564859 1/2005
CN 1726371 1/2006
(Continued)

OTHER PUBLICATIONS

Office Action issued in CA 2831944 dated Feb. 11, 2015.
(Continued)

*Primary Examiner* — Avinash Savani
(74) *Attorney, Agent, or Firm* — DLA Piper LLP (US)

(57) ABSTRACT

In one embodiment of a method for vaporizing liquids such as fuels, the liquid is sprayed into a chamber such that the spray does not impinge on any surface. The energy for vaporization is supplied through the injection of a hot diluent such as nitrogen or oxygen depleted air. Additional heat is added through the surface. In another embodiment, the liquid is sprayed onto a hot surface using a geometry such that the entire spray is intercepted by the surface. Heat is added through the surface to maintain an internal surface temperature above the boiling point of the least volatile component of the liquid. The liquid droplets impinging on the surface are thus flash vaporized. A carrier gas may also be flowed through the vaporizer to control the dew point of the resultant vapor phase mixture.

17 Claims, 6 Drawing Sheets

Related U.S. Application Data

(60) Provisional application No. 60/634,221, filed on Dec. 8, 2004.

(58) Field of Classification Search
USPC ..... 431/207, 211, 11
See application file for complete search history.

(56) References Cited

U.S. PATENT DOCUMENTS 1,544,607 A 7/1925 Simmons
1,755,846 A 4/1930 Steed
2,216,178 A 10/1940 Astradsson
2,256,785 A 9/1941 Dalen et al.
2,268,603 A 1/1942 Linder
2,354,179 A 7/1944 Blanc
2,377,342 A 6/1945 Holicer
2,701,608 A 2/1955 Johnson
RE24,682 E 8/1959 Johnson
3,229,464 A 1/1966 Mock
3,254,695 A 6/1966 Brodlin
3,545,902 A 12/1970 Bailey
3,564,847 A 2/1971 Wagner
3,568,934 A 3/1971 Dunn
3,576,382 A 4/1971 Finnstrand
3,597,134 A 8/1971 Bailey
3,602,202 A 8/1971 Kobayashi
3,603,711 A 9/1971 Downs
3,800,533 A 4/1974 Zankowski
3,832,985 A 9/1974 Edde
3,840,321 A 10/1974 Moench
3,847,534 A 11/1974 Nomaguchi et al.
3,866,585 A 2/1975 Kopa
163,323 A 5/1975 Martin
3,937,008 A 2/1976 Markowski et al.
3,973,395 A 8/1976 Markowski et al.
3,986,815 A 10/1976 Miyahara
3,990,831 A 11/1976 Syska
4,004,875 A 1/1977 Zink et al.
4,008,041 A 2/1977 Roffe et al.
4,013,396 A 3/1977 Tenney
4,019,314 A 4/1977 Springmann
4,023,538 A 5/1977 Harpman et al.
4,025,282 A 5/1977 Reed et al.
4,028,044 A 6/1977 Carlisle
4,033,725 A 7/1977 Reed et al.
4,040,403 A 8/1977 Rose et al.
4,044,875 A 8/1977 Greenwald et al.
4,045,956 A 9/1977 Markowski et al.
4,047,880 A 9/1977 Caldarelli
4,058,977 A 11/1977 Markowski et al.
4,088,437 A 5/1978 Holzapfel
4,094,291 A 6/1978 Hamburg
4,099,382 A 7/1978 Paull et al.
4,114,566 A 9/1978 Harpman et al.
4,140,473 A 2/1979 Hoehing et al.
4,148,599 A * 4/1979 Reed ..... F23D 17/002 261/128
4,173,254 A 11/1979 Paull et al.
4,212,163 A 7/1980 Mikina
4,250,704 A 2/1981 Bruckner et al.
4,270,506 A 6/1981 Lowe
4,277,416 A 7/1981 Grant
4,289,475 A 9/1981 Wall et al.
4,295,821 A 10/1981 Schilling
4,302,180 A 11/1981 Le Mer
4,318,689 A 3/1982 Forster et al.
4,333,735 A 6/1982 Hardy et al.
4,375,799 A 3/1983 Swanson
4,399,079 A 8/1983 Lowe
4,416,613 A 11/1983 Barisoff
4,443,180 A 4/1984 LeFrois
4,480,986 A 11/1984 Nelson et al.
4,483,832 A 11/1984 Schirmer
4,588,375 A 5/1986 Sandstrom
4,606,720 A 8/1986 Harvey
4,624,631 A 11/1986 Kobayashi et al.
4,646,705 A 3/1987 Babitzka et al.
4,659,743 A 4/1987 Rao et al.
4,697,415 A 10/1987 Schiffers
4,729,217 A 3/1988 Kehlhofer
4,784,599 A 11/1988 Garbo
4,838,029 A 6/1989 Gleason et al.
4,907,565 A 3/1990 Bailey et al.
4,909,192 A 3/1990 Forster et al.
4,909,728 A 3/1990 Nakamoto et al.
4,928,015 A 5/1990 Butler et al.
5,015,173 A 5/1991 Fullemann et al.
5,035,227 A 7/1991 Hansen
5,138,163 A 8/1992 Butler et al.
5,156,002 A 10/1992 Mowill
5,165,224 A 11/1992 Spadaccini et al.
5,207,053 A 5/1993 Spadaccini
5,238,396 A 8/1993 Yap
5,345,756 A 9/1994 Jahnke et al.
5,346,391 A 9/1994 Fullemann et al.
5,359,847 A 11/1994 Pillsbury et al.
5,377,483 A 1/1995 Mowill
5,388,395 A 2/1995 Scharpf et al.
5,394,686 A 3/1995 Child et al.
5,410,869 A 5/1995 Muller
5,417,053 A 5/1995 Uji
5,459,994 A 10/1995 Drnevich
5,464,344 A 11/1995 Hufton
5,473,882 A 12/1995 Zarzalis et al.
5,481,866 A 1/1996 Mowill
5,572,861 A 11/1996 Shao
5,713,195 A 2/1998 Bronicki et al.
5,740,673 A 4/1998 Smith et al.
5,756,360 A 5/1998 Harvey et al.
5,775,091 A 7/1998 Bannister et al.
5,794,431 A 8/1998 Utamura et al.
5,806,298 A 9/1998 Klosek et al.
5,848,885 A 12/1998 Tanaka et al.
5,901,547 A 5/1999 Smith et al.
5,979,183 A 11/1999 Smith et al.
6,039,261 A 3/2000 Pavese
6,067,789 A 5/2000 Dobbeling et al.
6,145,294 A 11/2000 Traver et al.
6,167,691 B1 1/2001 Yoshikawa et al.
6,170,264 B1 1/2001 Viteri et al.
6,174,160 B1 1/2001 Lee et al.
6,200,128 B1 3/2001 Kobayashi
6,220,034 B1 4/2001 Mowill
6,282,901 B1 9/2001 Marin et al.
6,341,486 B2 1/2002 Hannermann
6,343,462 B1 2/2002 Drnevich et al.
6,350,116 B1 2/2002 Herrmann
6,408,612 B2 6/2002 Hannermann et al.
6,430,915 B1 8/2002 Wiant et al.
6,434,925 B2 8/2002 Hannermann et al.
6,499,991 B1 12/2002 Usami et al.
6,508,053 B1 1/2003 Ha et al.
6,579,086 B2 6/2003 Fullemann et al.
6,588,212 B1 7/2003 Wallace et al.
6,596,780 B2 7/2003 Jahnke et al.
6,632,085 B1 10/2003 Suzuki et al.
6,718,794 B2 4/2004 Brugerolle et al.
6,779,333 B2 8/2004 Gerhold
6,910,335 B2 6/2005 Viteri et al.
6,923,642 B2 8/2005 Sennoun et al.
6,928,821 B2 8/2005 Gerhold
6,932,594 B2 8/2005 Weclas et al.
6,978,619 B2 12/2005 Blomeyer
7,089,745 B2 8/2006 Roby et al.
7,322,198 B2 1/2008 Roby et al.
7,770,396 B2 8/2010 Roby et al.
7,823,570 B2 11/2010 Cracknell et al.
2003/0131582 A1 7/2003 Anderson et al.
2004/0065088 A1 4/2004 Viteri et al.
2004/0134194 A1 7/2004 Roby et al.
2004/0170936 A1 9/2004 Weclas et al.
2004/0177617 A1 9/2004 Frutschi et al.
2004/0216465 A1 11/2004 Sheppard et al.
2004/0247499 A1 12/2004 Matsuoka et al.

(56) References Cited

U.S. PATENT DOCUMENTS

| | | | |
|---|---|---|---|
| 2006/0127827 | A1 | 6/2006 | Yoshida et al. |
| 2006/0149423 | A1 | 7/2006 | Barnicki et al. |
| 2006/0154189 | A1 | 7/2006 | Ramotowski et al. |
| 2007/0125091 | A1 | 6/2007 | Roby et al. |
| 2007/0254966 | A1 | 11/2007 | Eskin et al. |
| 2008/0115502 | A1 | 5/2008 | Roby et al. |
| 2009/0031968 | A1 | 2/2009 | Cracknell et al. |
| 2009/0084082 | A1 | 4/2009 | Martin et al. |
| 2010/0300063 | A1 | 12/2010 | Palmer et al. |
| 2010/0300103 | A1 | 12/2010 | Roby et al. |

FOREIGN PATENT DOCUMENTS

| | | |
|---|---|---|
| DE | 43 25 802 | 2/1995 |
| DE | 197 28 151 | 1/1999 |
| DE | 100 10 546 | 9/2000 |
| EP | 0 575 043 | 12/1994 |
| EP | 0 877 156 | 11/1998 |
| JP | 56-160515 | 12/1981 |
| JP | 58-71987 | 4/1983 |
| JP | 62-108911 | 5/1987 |
| JP | 63-80058 | 4/1988 |
| JP | 3-168505 | 7/1991 |
| JP | 4-60307 | 2/1992 |
| JP | 06-058508 | 3/1994 |
| JP | 06-265146 | 9/1994 |
| JP | 11-30423 | 2/1999 |
| JP | 11-51312 | 2/1999 |
| JP | 2003-226884 | 8/2003 |
| JP | 2006-503259 | 1/2006 |
| WO | WO 88/03249 | 5/1988 |
| WO | WO 90/08962 | 8/1990 |
| WO | WO 02/099334 | 12/2002 |
| WO | WO 2005/054657 | 6/2005 |

OTHER PUBLICATIONS

Office Action issued in Norwegian Application No. 20072867 dated Feb. 20, 2015.
English language translations Office Action issued in Norwegian Application No. 20072867 dated Feb. 20, 2015.
Office Action issued in Mylasian Application No. PI20084332 dated Dec. 31, 2014.
A.H Lefebvre, "Gas Turbine Comubustion," Emissions, Thermal Sciences and Propulsion Center School of Mechanical Engineering Purdue University, pp. 487-490, Undated.
Stoffel, et al., "Conversion of Liquid to Gaseous Fuels for Lean Premixed Combustion," Presented at the International Gas Turbine and Aeroengine Congress and Exposition, Houston, TX, Jun. 5-8, 1995 (10 pages).
Turns, S.R., "An Introduction to Combustion Concepts and Applications," Second Addition, Chapter I, Propulsion Engineering Research Center and Department of Mechanical and Nuclear Engineering, The Pennsylvania State University, McGraw Hill, pp. 6-8, undated.
Wei, et al., "Experimental Investigation of the Prevaporized Premixed (vpl) Combustion Process for Liquid Fuel Lean Combustion," Chemical Engineering and Processing, vol. 41, pp. 157-164 (2002).
Abstract of Cowell, et al., "Development of a Dual-Fuel Injection System for Lean Premixed Industrial Gas Turbines," American Society of Mechanical Engineers, New York, NY, vol. 39, p. 3268 (1996).
Davis, L.B., et al., "Dry Low NOx Combustion Systems for GE Heavy-Duty Gas Turbines," GE Power Systems, GER-3568G, Oct. 2000 (25 pages).
Abstract of Gillispie, et al., "Effects of Fuel Gas Mixtures on Power Limits in a Dual-Fuel Engine," Natural Gas and Alternative Fuels for Engines American Society of Mechanical Engineers, Internal Combustion Engine Division, vol. 30, p. 2794 (1994).
Hoffmann, S., et al., "Further Development of the Siemens LPP Hybrid Burner," ASME-IGTI 98-GT-552, presented at the International Gas Turbine & Aeroengine Congress & Exhibition, Stockholm, Sweden, Jun. 2-5, 1998 (7 pages).
Office Action issued in CA 2,501,862, dated May 8, 2009.
Office Action issued in MX/a/2007/006899, dated May 30, 2011.
Partial English translation of Office Action issued in MX/a/2007/006899, dated May 30, 2011.
International Search Report issued in International Application No. PCT/US2003/32423, dated Aug. 17, 2004.
Philip C. Malte et al., "The Staged Prevaporizing=Premixing Injector; High Pressure Evaluation," AGTSR Subaward No. 0-01-SR087, Final Report from the University of Washington, Dec. 2002.
"Summary Health Statistics for U.S. Adults: National Health Interview Survey, 2001," Vital and Health Statistics, Series 10, No. 218, Jan. 2004.
Marty Ahrens, "The U.S. Fire Problem Overview Report Leading Causes and Oterh Ptterns and Trends," NFPA, Fire Analysis and Research Division, Jun. 2003.
International Search Report issued in PCT/US2005/04414, dated Nov. 1, 2006.
Written Opinion issued in PCT/US2005/04414, dated Nov. 1, 2006.
International Preliminary Report on Patentability issued in PCT/US2005/04414, dated Jun. 13, 2007.
Japanese Office Action issued in JP 2005-501180, dated Jun. 16, 2009.
English translation of Japanese Office Action issued in JP 2005-501180, dated Jun. 16, 2009.
Enlgish language abstract of JP 11-051312, published Feb. 26, 1999.
Machine Enlgish language translation of JP 11-051312, published Feb. 26, 1999.
English language abstract of JP 56-160515, published Dec. 10, 1981.
Office Action issued in CN 200380105739.9, dated Nov. 17, 2006.
English translation of Chinese Office Action issued in CN 200380105739.9, dated Nov. 17, 2006.
Office Action issued in AU 2003284124, dated Oct. 29, 2008.
Office Action issued in KR 10-2005-7006266, dated Jun. 29, 2007.
English translation of Office Action issued in KR 10-2005-7006266, dated Jun. 29, 2007.
Office Action issued in CN 200710166824.6, dated Jun. 5, 2009.
English translation of Office Action issued in CN 200710166824.6, dated Jun. 5, 2009.
Office Action issued in CN200710166824.6, dated Jan. 8, 2010.
English translation of Office Action issued in CN 200710166824.6, dated Jan. 8, 2010.
Office Action issued in CN 200710166824.6, dated Nov. 15, 2010.
English translation of Office Action issued in CN 200710166824.6, dated Nov. 15, 2010.
Office Action issued in NZ 539362, dated May 1, 2006.
Office Action issued in CN 200580041555.X, dated Feb. 6, 2009.
English translation of Office Action issued in CN 200580041555.X, dated Feb. 6, 2009.
Office Action issued in CN 200580041555.X, dated Jan. 29, 2010.
English translation of Office Action issued in CN 200580041555.X, dated Jan. 29, 2010.
Office Action issued in CN 200580041555.X, dated Nov. 22, 2010.
English translation of Office Action issued in CN 200580041555.X, dated Nov. 22, 2010.
International Search Report issued in PCT/US2007/067891, dated Mar. 10, 2008.
Written Opinion issued in PCT/US2007/067891, dated Mar. 10, 2008.
International Preliminary Report on Patentability issued in PCT/US2007/067891, dated Nov. 13, 2008.
Office Action issued in MX PA/a/2005/003786, dated Jun. 4, 2010.
Partial English language translation of Office Action issued in MX PA/a/2005/003786, dated Jun. 4, 2010.
Office Action issued in AU 2005314037, dated Dec. 21, 2009.
Office Action issued in NZ 555544, dated Oct. 7, 2010.
Office Action issued in MY PI 20070934, dated Jun. 30, 2010.
Office Action issued in CN 200780015985.3, dated Jun. 15, 2011.

(56) References Cited

OTHER PUBLICATIONS

Partial English language translation of Office Action issued in CN 200780015985.3, dated Jun. 15, 2011.
English language abstract of JP 06-058508, published Mar. 1, 1994.
Machine English language translation of JP 06-058508, published Mar. 1, 1994.
English language abstract of JP 06-265146, published Sep. 20, 1994.
Machine English language translation of JP 06-265146, published Sep. 20, 1994.
English language abstract of JP 11-30423, published Feb. 2, 1999.
Machine English language translation of JP 11-30423, published Feb. 2, 1999.
English language abstract of CN 1564859, published Jan. 12, 2005.
English language abstract of JP 03-168505, published Jul. 22, 1991.
English language abstract of JP 04-60307, published Feb. 26, 1992.
English language abstract of JP 63-80058, published Apr. 11, 1988.
English language abstract of JP 62-108911, published May 20, 1987.
Abstract of Stoffel, et al., "Conversion of Liquid to Gaseous Fuels for Lean Premixed Combustion," Presented at the International Gas Turbine and Aeroengine Congress and Exposition, Houston, TX, Jun. 5-8, 1995 (10 pages).
Abstract of Wei, et al., "Experimental Investigation of the Prevaporized Premixed (vpl) Combustion Process for Liquid Fuel Lean Combustion," Chemical Engineering and Processing, vol. 41, pp. 157-164 (2002).
Arthur H. Lefebvre, "Gas Turbine Combustion; Second Edition", Printed by Edward brothers 1998, pp. 57-62.
Supplementary European Search Report issued in EP 03 77 6355, dated Aug. 4, 2011.
English language abstract of EP 0 877 156, published Nov. 11, 1998.
English language abstract of DE 100 10 546 published Sep. 7, 2000.
English language abstract of DE 43 25 802 published Feb. 2, 1995.
English language abstract of DE 197 28 151 pubslished Jan. 7, 1999.
Office Action issued in Mexican Application No. MX/a/2007/006899, dated Jan. 10, 2012.
Partial English language translation of Office Action issued in Mexican Application No. MX/a/2007/006899, dated Jan. 10, 2012.
Office Action issued in Australian Application No. 2007258113, dated Jan. 17, 2012.
Office Action issued in Chinese Application No. 200780015985.3, dated May 3, 2012.
English language translation Office Action issued in Chinese Application No. 200780015985.3, dated May 3, 2012.
Office Action issued in European Application No. EP 03776355.4, dated Jun. 20, 2012.
Office Action issued in Chinese Application No. 200780015985.3, dated Aug. 23, 2012.
English language translation Office Action issued in Chinese Application No. 200780015985.3, dated Aug. 23, 2012.
Office Action issued in Japanese Application No. 2009-510013, dated Dec. 4, 2012.
English language translation Office Action issued in Japanese Application No. 2009-510013, dated Dec. 4, 2012.
English language abstract of JP 2003-226884, published Aug. 15, 2003.
Machine English language translation of JP 2003-226884, published Aug. 15, 2003.
English language abstract of JP 2006-503259, published Jan. 26, 2006.
Machine English language translation of JP2006-503259, published Jan. 26, 2006.
Office Action issued in EP 03 776 335.4 dated Apr. 12, 2013.
Office Action issued in KR 10-2008-7029206 dated May 9, 2013.
English language translation of Office Action issued in KR 10-2008-7029206 dated May 9, 2013.
U.S. Appl. No. 10/682,408.
U.S. Appl. No. 11/464,441.
U.S. Appl. No. 11/929,675.
U.S. Appl. No. 12/851,379.
U.S. Appl. No. 11/742,478.
U.S. Appl. No. 11/296,426.
English Language Translation of Office Action issued in Brazilian Application No. PI0711275-0, dated Jul. 18, 2016.
Office Action issued in Norwegian Application No. 20052247, dated May 12, 2016 (with Partial English Language Translation).
EPO Extended Search Report issued in EP 16 153 956.4, dated Sep. 12, 2016.
EPO Communication issued in European Application No. 07 815 110.7, dated Jul. 19, 2016.
Office Action issued in Mexican Application No. MX/a/2010/008893, dated Aug. 5, 2016 (with Partial English Language Translation).
English Language Translation of Office Action issued in Indonesian Application No. W-00200701779, dated Feb. 14, 2017.
Office Action issued in Indonesian Application No. W-00200701779, dated Feb. 14, 2017.

* cited by examiner

METHOD AND APPARATUS FOR CONDITIONING LIQUID HYDROCARBON FUELS

CROSS-REFERENCE TO RELATED APPLICATIONS

This application is a Continuation of U.S. patent application Ser. No. 11/296,426, filed Dec. 8, 2005, which claims priority from U.S. Provisional Patent Application No. 60/634,221 filed Dec. 8, 2004. All of the foregoing are incorporated by reference in their entireties.

BACKGROUND INFORMATION

Low emissions from combustion devices are obtained by burning a lean mixture of fuel and air obtained by pre-mixing gaseous fuel and air. Dry Low NOx (DLN) technology gas turbines, for example, typically burn natural gas under lean, pre-mixed conditions. Liquid fuels, by contrast, are typically burned by injecting a fuel spray directly into the combustor. This results in a diffusion flame in which the fuel is burned in a locally stoichiometric fuel/air mixture and causes high emissions. Under certain conditions, burning a liquid fuel is more desirable than burning a gaseous fuel. However, it would be desirable to avoid the high emissions associated with diffusion flames when burning such liquid fuels.

SUMMARY

A method and apparatus for conditioning liquid fuels at a location external to a combustion device so that the resulting vapor phase fuel may be pre-mixed with air and burned under lean conditions, thus achieving low emissions, is described herein. Preferably, the liquid fuel is conditioned such that it may be used in a combustor configured for natural gas without modification to the combustor/fuel metering system. In one embodiment, the liquid fuel is sprayed into a vaporization chamber such that the spray does not impinge on any surface. The energy for vaporization is supplied through the injection of a hot diluent such as nitrogen or oxygen depleted air. Additional heat is added through the surface of the chamber to prevent heat loss and to maintain an internal surface temperature above the boiling point of the least volatile component of the liquid. The diluent gas also serves to control the dew point of the resultant vapor phase mixture. Additional heating to augment the vaporization process in the event that the diluent flow or temperature fall below the minimum levels needed for complete vaporization is supplied by internal heaters.

In another embodiment, the liquid fuel is sprayed onto a hot surface using a geometry such that the entire spray is intercepted by the surface. Heat is added through the surface to maintain an internal surface temperature above the boiling point of the least volatile component of the liquid fuel. The liquid droplets impinging on the surface are thus flash vaporized such that there is no build up of bulk liquid or a liquid film in the vaporizer. A carrier gas, such as nitrogen or air, may also be flowed through the vaporizer to control the dew point of the resultant vapor phase mixture. In some embodiments, a fuel nozzle is mounted at one end (the enclosed end) of a cylindrical chamber. The nozzle forms a hollow cone type spray with a spray angle chosen such that all of the spray impinges on the cylinder surface (in other embodiments a solid cone type spray nozzle is used). The preferred orientation is vertical, with the spray downward, so that the impingement of the spray on the walls is even. Two or more such chambers can be joined to a common manifold to accommodate higher capacities.

BRIEF DESCRIPTION OF THE FIGURES

The features and advantages of the present invention will become more apparent from the detailed description set forth below when taken in conjunction with the drawings in which like reference numbers indicate identical or functionally similar elements.

FIG. **6*a*** illustrates an embodiment in which a preheater is used to preheat a liquid fuel supply.

FIG. **6*b*** illustrates an embodiment in which a preheater is used to preheat a liquid gas supply.

DETAILED DESCRIPTION

Various embodiments of methods and apparatuses for conditioning liquid fuels are discussed below. Specific details are set forth in order to provide a thorough understanding of the present invention. The specific embodiments described below should not be understood to limit the invention. Additionally, for ease of understanding, certain method steps are delineated as separate steps. These steps should not be understood as necessarily distinct or order-dependent in their performance unless so indicated.

The complete disclosure of U.S. patent application Ser. No. 10/682,408, which was filed Oct. 10, 2003 (now U.S. Pat. No. 7,089,745), and which describes methods and devices for vaporizing, mixing, and delivering liquid fuels or liquefied gases which have been pre-vaporized with a reduced oxygen content air stream for use in combustion devices, is fully incorporated herein by reference. In addition, U.S. Patent Application Ser. No. 60/535,716, filed Jan. 12, 2004, and Ser. No. 11/033,180, filed Jan. 12, 2005 (now U.S. Pat. No. 7,435,080), which disclose systems and methods for flame stabilization and control, are both also fully incorporated herein by reference.

In some embodiments of a method and apparatus for conditioning liquids, such as hydrocarbon fuels, the liquid is sprayed into a chamber such that the spray does not impinge on any surface. The energy for vaporization is supplied through the injection of a hot diluent such as nitrogen or oxygen depleted air. Additional heat is added through the surface to prevent heat loss and to maintain an internal surface temperature above the boiling point of the least volatile component of the liquid. The diluent gas also serves to control the dew point of the resultant vapor phase mixture. Additional heating to augment the vaporization process in the event that the diluent flow or temperature fall below the minimum levels needed for complete vaporization is supplied by internal heaters. One application of the invention is the vaporization of liquid fuels, such as kerosene and heating oil, for introduction into a combustion device, such as a gas turbine. Pre-vaporizing the fuel in this manner allows the operation of the gas turbine in the lean, premixed mode, resulting in extremely low pollutant emissions.

Figure 1:
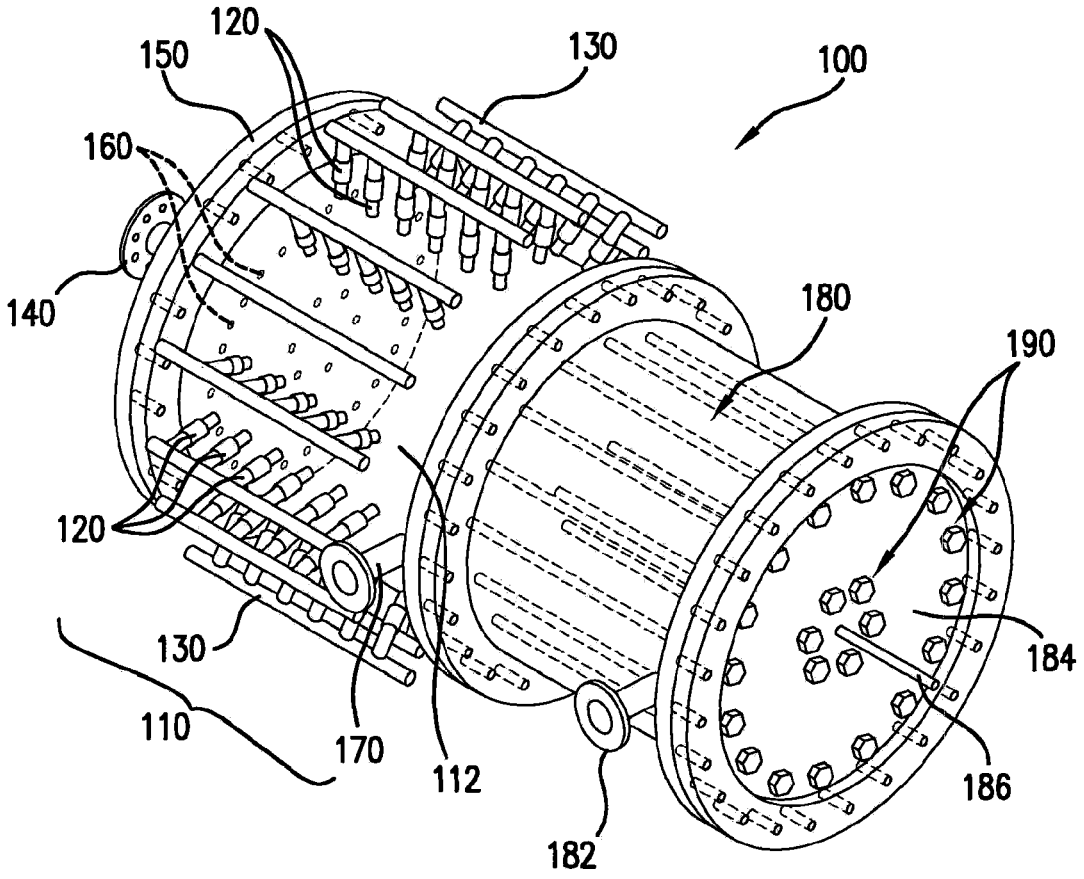
FIG. 1 is a schematic drawing of a fuel vaporizer according to a first embodiment of the invention.

FIG. 1 illustrates a fuel conditioner 100 according to such an embodiment of the invention. The fuel conditioner 100 includes a cylindrical vaporization chamber 110. Liquid fuel is sprayed into the chamber 110 through nozzles 120 mounted on the sidewall 112 of the chamber 110. The nozzles 120 are pressure atomizing spray nozzles in some embodiments. In other embodiments, the nozzles 120 may be two-fluid nozzles (such as filming or "air" blast type nozzles), in which case the diluent (or carrier) gas may enter the chamber 110 through such two-fluid nozzles. In an alternative embodiment, the nozzles are mounted on a manifold which runs parallel to the axis of the cylindrical chamber and which gets installed from an end of the chamber.

In some embodiments, the sidewall and/or end wall of the chamber 110 are heated. In some embodiments, heating tape or heat tracing (MI cable) (not shown in FIG. 1) is used to heat the sidewall and/or end wall. As discussed above, the heating of the sidewall and/or end wall of the chamber 110 serves to prevent heat loss and maintain an internal surface temperature above that of the boiling point for least volatile component of the liquid fuel.

In the embodiment of FIG. 1, the nozzles 120 are arranged in rings spaced around the circumference of the cylinder, with each column of nozzles 120 supplied by one of a plurality of manifolds 130. Diluent gas is supplied through an inlet 140 that is in fluid communication with a plenum 150 formed by a space between the top end wall 160 of the chamber 110 and a perforated plate 160. The diluent gas enters the interior of the chamber 110 through perforations in the plate 160. The diluent gas is preferably a gas that has less oxygen than ambient air, such as nitrogen, steam, methane, oxygen depleted air, or exhaust gas from a combustion device. The diluent gas is preferably heated to at least the boiling point of the liquid such that the diluent gas supplies the heat required for vaporization of the liquid fuels entering the chamber 110 through the nozzles 120. As discussed above, the diluent gas also serves to lower the dew point of the vapor phase mixture. Lowering the dew point temperature is desirable so that downstream components, such as the line connecting the vaporizer to the combustion device, can be maintained at a temperature lower than that required for the initial vaporization. The use of an inert carrier gas can also serve to limit chemical reaction in the conditioner 100 and transfer lines connecting the conditioner 100 to a combustor, thus suppressing coking Vaporized fuel exits the chamber through one or more exit ports 170 for transport to the combustion device.

In alternative embodiments, the diluent gas is introduced into the chamber 110 through nozzles arranged on the sidewall of the chamber 110 and positioned, for example, between the nozzles 120 and or on one of the end walls of the chamber 110. Depending on the location and method in which the diluent gas is introduced into the chamber 110, the diluent gas may be introduced in a co-flow arrangement, a counter-flow arrangement, and/or at various angles in order to, for example, induce a swirling flow inside the chamber 110.

Figure 4:
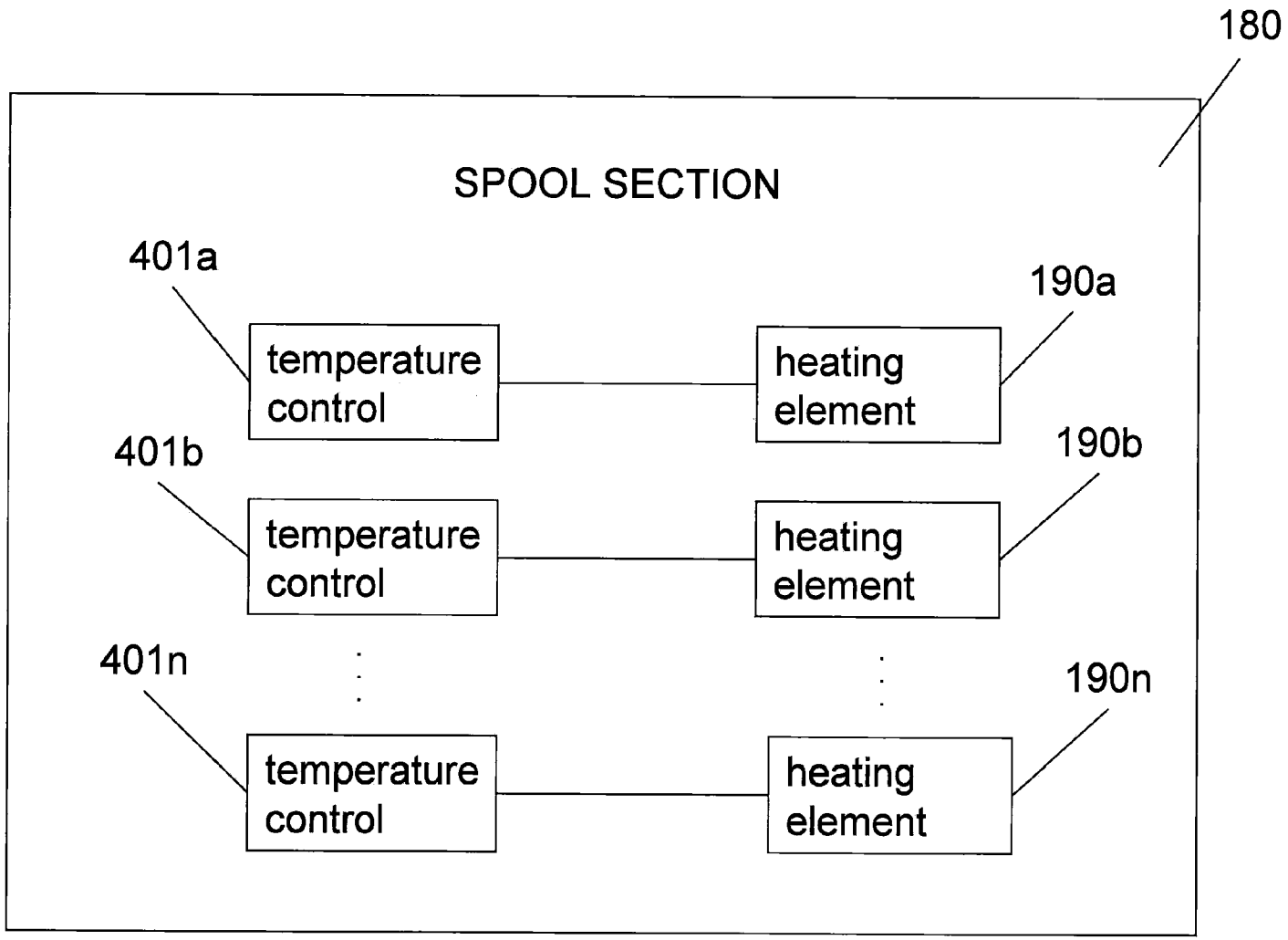
FIG. 4 is a block diagram showing electrical components of the fuel vaporizer for FIG. 1.

Referring now back to FIG. 1, an optional spool section 180 is attached to the chamber 110 in some embodiments. The length of the spool section 180 is chosen to increase the vaporizer residence time so that it is sufficient for complete evaporation of the fuel droplets. The spool section 180 preferably has a plurality of heating elements 190 disposed therein (two concentric rings of heating elements 190 are illustrated in FIG. 1). The heating elements 190 preferably extend the length of the spool section 180, and may be electrical bayonet heaters, heat exchange tubes, or any other type of heating element. In some embodiments, each heating element 190*a-n* is provided with a separate temperature control 401*a-n* as shown in FIG. 4.

The spool section 180 also includes one or more exit ports 182, similar to those of the chamber 110, through which vaporized liquid may exit the spool section 182. A drain 186 passes through the end cap 184 of the spool section 180 to allow any unvaporized liquids to be removed from the conditioner 100.

The spool section 180 may include a particulate collection device (not shown in FIG. 1) in some embodiments. The particulate collection device controls particulate or droplet carryover exiting the conditioner 100. Possible particulate control devices include mist eliminators, cyclones, and filter elements.

In some embodiments, a preheater (not shown in FIG. 1) is used to pre-heat the liquid prior to entry into the chamber 110. This lowers the amount of heat needed to vaporize the liquid in the chamber 110. Preheating also lowers the viscosity of the liquid, which improves the quality of the spray produced by the nozzles 120.

It should be understood that the number of nozzles 120, the length of the chamber 110 and the spool section 180 can be modified to suit desired operating conditions (e.g., volume of fuel needed, type of liquid fuel to be conditioned, etc.). Thus, the design illustrated in FIG. 1 is easily scalable for a variety of operating conditions.

In the embodiments discussed above in connection with FIG. 1, the liquid fuel does not impinge on any interior surface. In other embodiments, such as those illustrated in FIGS. 2 and 3, the liquid fuel does impinge on interior surfaces of a vaporization chamber. In such embodiments, the energy for vaporization is supplied by heat transfer through the walls of the vaporization chamber. The essential design feature of a fuel conditioner operating in this manner is the match of the heat transfer rate through the walls to the heat required to vaporize the liquid. This is achieved by matching the surface area used for vaporization with the liquid flow rate and the achievable heat flow through the walls. Since the heat requirement is different in different sections of the vaporizer, the heat input may be staged with separate temperature control for each stage.

Figure 2:
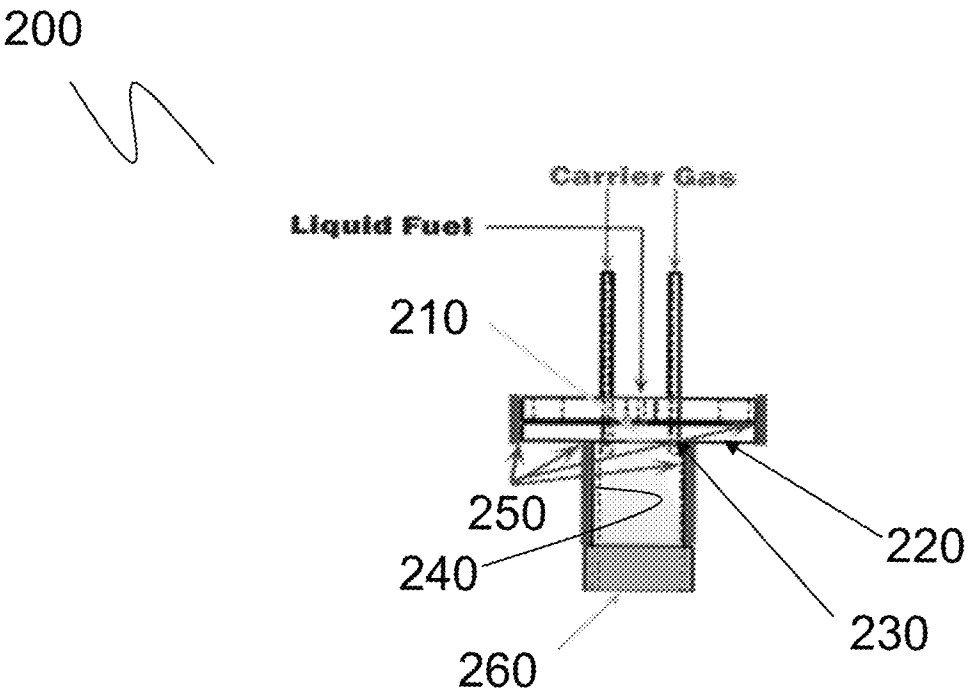
FIG. 2 is a schematic drawing of a single nozzle vaporizer according to a second embodiment of the invention.

FIG. 2 is a schematic drawing of a single nozzle vaporizer 200 according to a second embodiment of the invention. Liquid fuel is sprayed into the vaporizer 200 through a nozzle 210 mounted on the end flange 220. A carrier gas such as nitrogen or air, which is preferably pre-heated to supply some of the heat required for vaporization, is also introduced through ports 230 on the end flange 220. As with the embodiment of FIG. 1, the use of a carrier gas serves two purposes: 1) to aid in removing the vapor from vaporizing chamber, and 2) to lower the dew point temperature of the vapor. Lowering the dew point temperature is desirable so that downstream components, such as the line connecting the vaporizer to a combustion device, can be maintained at a temperature lower than that required for the initial vaporization. The use of an inert carrier gas can also serve to limit chemical reaction in the vaporizer and transfer lines, thus suppressing coking There are many possible ways to introduce the carrier gas such as, but not limited to: in each vaporizer module, in the main body of the vaporizer, in an axial direction, and in a tangential direction to induce swirl. In the vaporizer 200, the carrier gas is injected tangentially at two ports 230 to induce a swirling co-flow.

Figure 5:
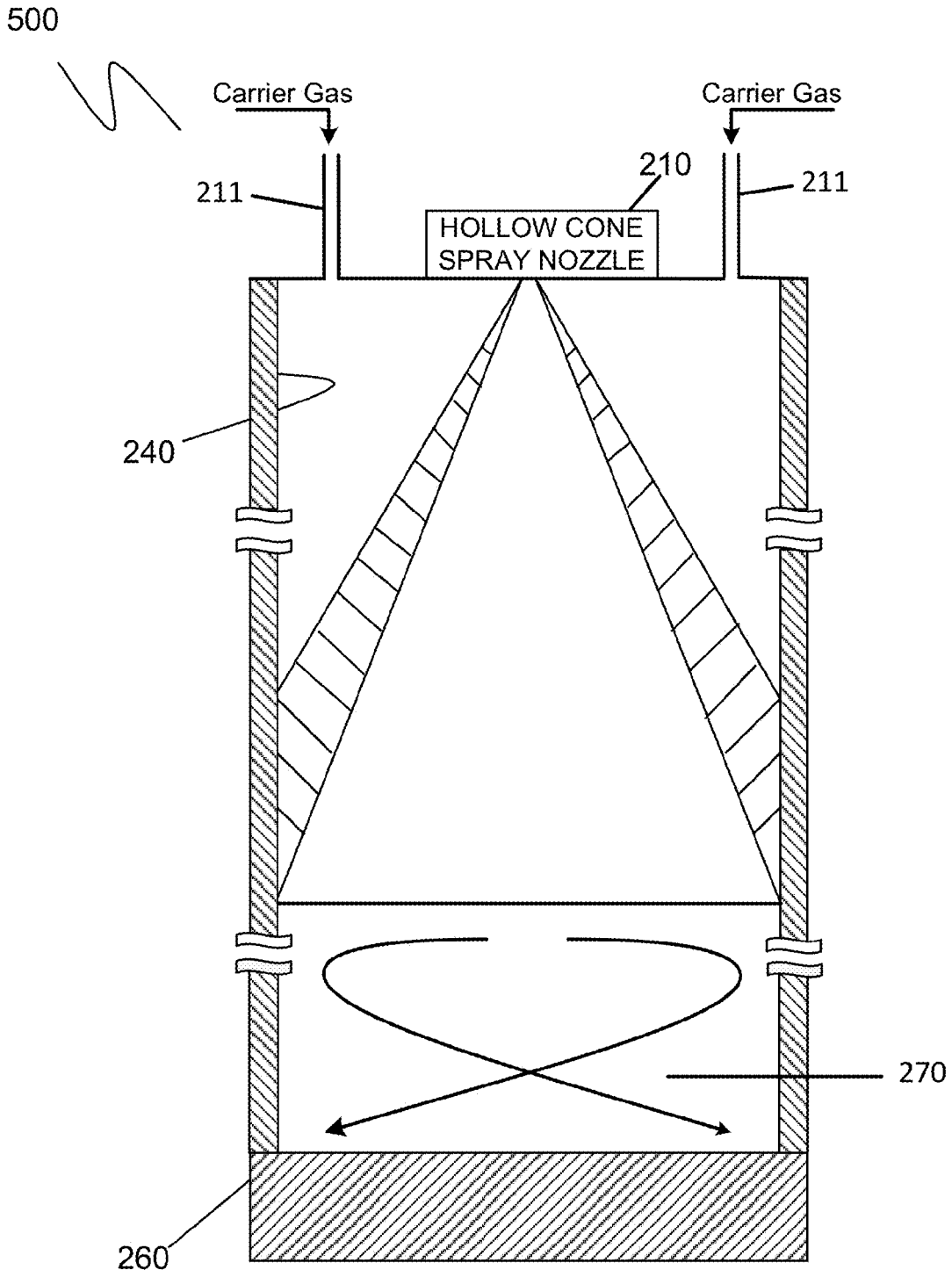
FIG. 5 illustrates a cross sectional view of the spray pattern of the single nozzle vaporizer of FIG. 2.

The resulting spray from the nozzle 210 impinges on the interior cylindrical surface 240 of the vaporizer 200, and is evaporated due to heat input through the surface and from the hot carrier gas. As shown in the cross sectional view 500 of FIG. 5 (not to scale), the nozzle 210 (shown in block form in FIG. 5) preferably forms a hollow cone type spray angle chosen such that all of the spray impinges on the cylinder surface. The carrier gas nozzle 211 supply the carrier gas in a direction tangential to a direction of the spray from the nozzle 210 to induce a swirling co-flow 270. Referring now back to FIG. 2, the surface 240 is heated by a combination of electrical heating tape 250 and band heaters 260 in this embodiment. In other embodiments, the heat input may be supplied by heat exchange with a hot liquid or gas (such as steam or hot combustion products).

Figure 3:
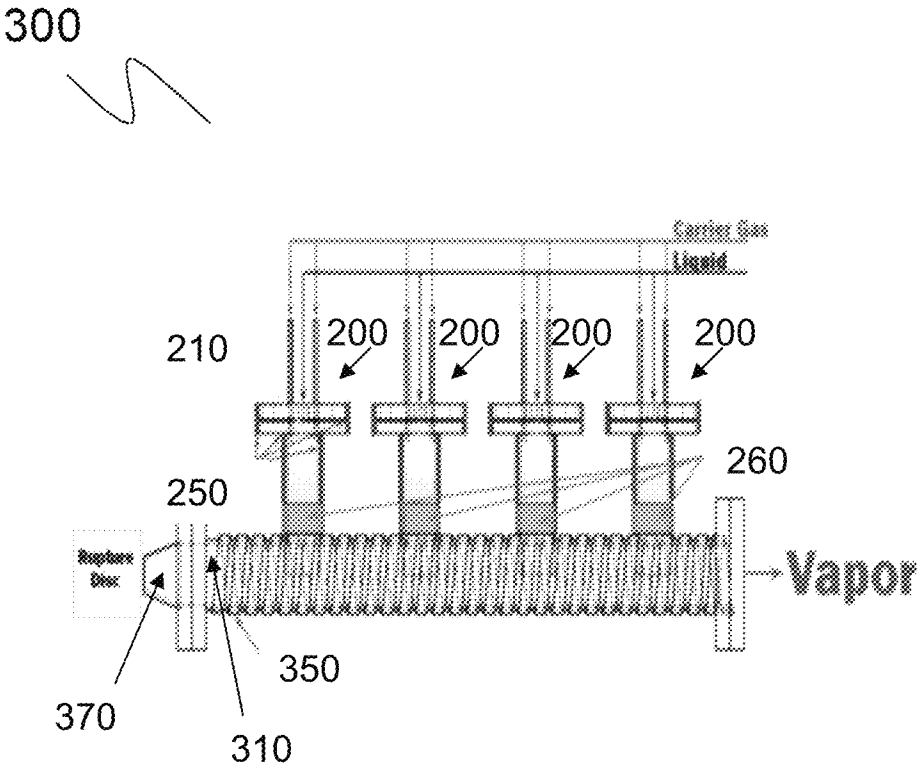
FIG. 3 is a schematic drawing of a plurality of the vaporizers of FIG. 2 joined to a common manifold according to a third embodiment of the invention.

FIG. 3 is a schematic diagram of a fuel conditioning system 300 with multiple single nozzle vaporization units 200. In order to maintain the optimum surface area to volume ratio for spray vaporization, additional capacity is obtained by grouping multiple vaporizer "legs" onto a common manifold 310. The body of the manifold 310 is also heated, in this case with heating tape 350. A rupture disc 370 is mounted on one end of the manifold 310 for safety. Vapor exits the other end of the manifold 310.

Figure 6A:
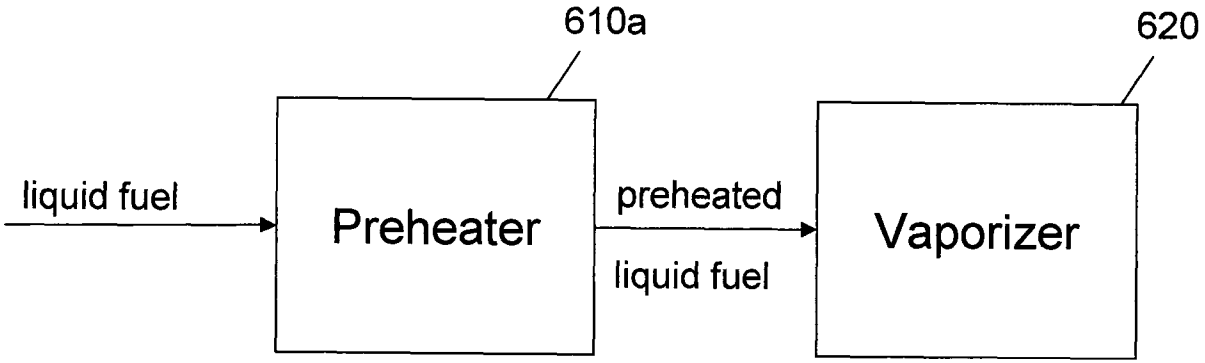
Figure 6B:
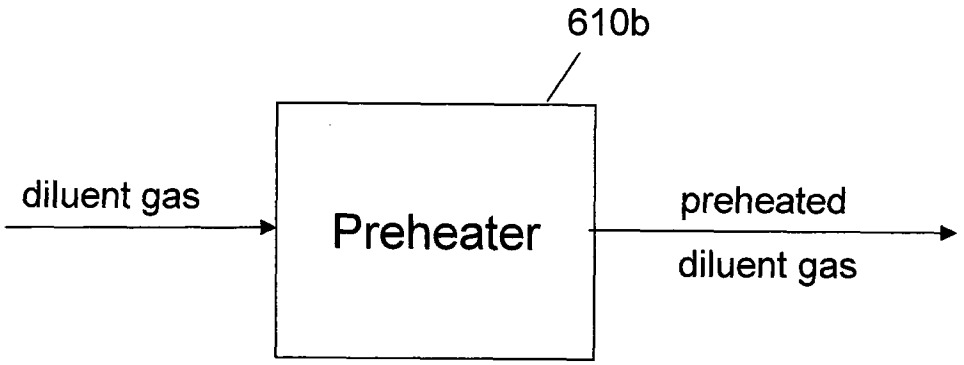

As discussed above, a preheater is used to preheat the liquid fuel prior to entry into the chamber of the vaporizer in some embodiments. An example is shown in FIG. 6*a*, which illustrates a preheater 610*a* that accepts liquid fuel and preheats. The preheated liquid fuel is then fed from the preheater 610*a* to a vaporizer 620 in accordance with one of the embodiments discussed above. Shown in FIG. 6*b* is a preheater 610*b* that preheats the diluent gas as discussed above.

Several embodiments of fuel conditioning devices have been discussed above. Numerous other modifications and variations of the present invention are possible in light of the above teachings. It is therefore to be understood that within the scope of the appended claims, the invention may be practiced otherwise than as specifically described herein.

The invention claimed is:

1. A fuel conditioning unit and combustion device comprising:

a cylindrical vaporization chamber, the cylindrical vaporization chamber comprising a sidewall and an end wall;

a plurality of nozzles mounted along the sidewall and in fluid communication with a liquid fuel supply, the nozzles being configured to spray liquid fuel radially inward into the chamber;

at least one diluent gas port in fluid communication with the chamber, the diluent gas port being in fluid communication with a supply of heated diluent gas, the diluent gas port being configured to introduce the diluent gas into the chamber;

at least one exit port in fluid communication with the chamber, the exit port providing a path for vaporized liquid fuel to exit the chamber; and a combustor in fluid communication with the exit port;

wherein the fuel conditioning unit is configured such that the mixture remains at a temperature above the dew point for the mixture until it is combusted in the combustor; and wherein the heated diluent gas supplies a least a portion of the heat required for vaporization of the liquid fuel, and wherein a mixture of the diluent gas and vaporized liquid fuel has an oxygen content below the limiting oxygen index and has a lower dew point than that of the liquid fuel in the absence of the diluent gas.

2. The fuel conditioning unit of claim 1, wherein the at least one diluent gas port comprises a plurality of diluent gas ports formed in a perforated plate located within the chamber, the perforated plate, the end wall and a portion of the sidewall forming a plenum in fluid communication with the plurality of diluent gas ports and the supply of heated diluent gas.

3. The fuel conditioning unit of claim 1, wherein at least a portion of the chamber sidewall or the chamber end wall is heated.

4. The fuel conditioning unit of claim 1, wherein the diluent gas is inert.

5. The fuel conditioning unit of claim 1, wherein each of the plurality of nozzles is oriented toward a central axis of the vaporization chamber.

6. A method for conditioning a liquid fuel comprising the steps of:

spraying the liquid fuel into a cylindrical vaporization chamber through a plurality of nozzles mounted on a sidewall of the chamber and in fluid communication with the chamber such that the liquid fuel does not impinge on any wall of the chamber;

supplying a heated diluent gas to the vaporization chamber through at least one diluent gas port in fluid communication with the chamber;

receiving a conditioned vaporized fuel gas from at least one exit port in fluid communication with the chamber, the conditioned vaporized fuel gas comprising a mixture of the diluent gas and a vaporized form of the liquid fuel, the conditioned vaporized fuel gas having an oxygen content below the limiting oxygen index and a lower dew point than that of the vaporized form of the liquid fuel in the absence of the diluent gas; and maintaining the conditioned vaporized fuel above the dew point until the conditioned vaporized fuel is combusted in a combustor in fluid communication with the exit port.

7. The method of claim 6, further comprising the step of heating at least a portion of a wall of the chamber.

8. The method of claim 6, wherein the diluent gas is inert.

9. A fuel conditioning unit comprising:

a cylindrical vaporization chamber, the cylindrical vaporization chamber comprising a sidewall and an end wall;

a plurality of nozzles mounted along the sidewall and in fluid communication with a liquid fuel supply, the nozzles being oriented toward a central axis of the vaporization chamber and configured to spray liquid fuel radially inward into the chamber;

at least one diluent gas port in fluid communication with the chamber, the diluent gas port being in fluid communication with a supply of heated diluent gas, the diluent gas port being configured to introduce the diluent gas into the chamber;

at least one exit port in fluid communication with the chamber, the exit port providing a path for vaporized liquid fuel to exit the chamber; and a combustor in fluid communication with the exit port;

wherein the fuel conditioning unit is configured such that the mixture remains at a temperature above the dew point for the mixture until it is combusted in the combustor; and wherein the heated diluent gas supplies a least a portion of the heat required for vaporization of the liquid fuel, and wherein a mixture of the diluent gas and vaporized liquid fuel has an oxygen content below the limiting oxygen index and has a lower dew point than that of the liquid fuel in the absence of the diluent gas.

10. The fuel conditioning unit of claim 9, wherein the at least one diluent gas port comprises a plurality of diluent gas ports formed in a perforated plate located within the chamber, the perforated plate, the end wall and a portion of the sidewall forming a plenum in fluid communication with the plurality of diluent gas ports and the supply of heated diluent gas.

11. The fuel conditioning unit of claim 9, wherein at least a portion of the chamber sidewall or the chamber end wall is heated.

12. The fuel conditioning unit of claim 9, wherein the diluent gas is inert.

13. The fuel conditioning unit of claim 9, further comprising a combustor in fluid communication with the exit port, wherein the fuel conditioning unit is configured such that the mixture remains at a temperature above the dew point for the mixture until it is combusted in the combustor.

14. A method for conditioning a liquid fuel comprising the steps of:

spraying the liquid fuel into a cylindrical vaporization chamber through a plurality of nozzles mounted on a sidewall of the chamber and in fluid communication with the chamber such that the liquid fuel does not impinge on any wall of the chamber, each of the plurality of nozzles bring oriented toward a central axis of the vaporization chamber;

supplying a heated diluent gas to the vaporization chamber through at least one diluent gas port in fluid communication with the chamber; and receiving a conditioned vaporized fuel gas from at least one exit port in fluid communication with the chamber, the conditioned vaporized fuel gas comprising a mixture of the diluent gas and a vaporized form of the liquid fuel, the conditioned vaporized fuel gas having an oxygen content below the limiting oxygen index and a lower dew point than that of the vaporized form of the liquid fuel in the absence of the diluent gas.

15. The method of claim 14, further comprising the step of heating at least a portion of a wall of the chamber.

16. The method of claim 14, wherein the diluent gas is inert.

17. The method of claim 14, further comprising the step of maintaining the conditioned vaporized fuel above the dew point until the conditioned vaporized fuel is combusted in a combustor in fluid communication with the exit port.

* * * * *